US008657322B2

(12) United States Patent
Samila

(10) Patent No.: US 8,657,322 B2
(45) Date of Patent: Feb. 25, 2014

(54) WHEELCHAIR MOUNT AND METHOD FOR STABILIZING A WHEELCHAIR COMPONENT

(75) Inventor: Ivan D. Samila, Stouffville (CA)

(73) Assignee: Invacare Corp., Elyria, OH (US)

( * ) Notice: Subject to any disclaimer, the term of this patent is extended or adjusted under 35 U.S.C. 154(b) by 147 days.

(21) Appl. No.: 13/188,925

(22) Filed: Jul. 22, 2011

(65) Prior Publication Data

US 2013/0020783 A1 Jan. 24, 2013

(51) Int. Cl.
*A47B 96/06* (2006.01)

(52) U.S. Cl.
USPC ..... 280/304.1; 403/384

(58) Field of Classification Search
USPC ..... 280/250.1, 304.1; 403/384
See application file for complete search history.

(56) References Cited

U.S. PATENT DOCUMENTS 5,797,697 A * 8/1998 Keller ..... 403/384
6,106,189 A * 8/2000 Seale ..... 403/398
6,123,482 A * 9/2000 Keller ..... 403/384
6,561,473 B1 * 5/2003 Ianello ..... 248/219.4
6,974,175 B2 * 12/2005 Willey ..... 296/78.1
7,637,754 B1 * 12/2009 Yerena et al. ..... 439/108

OTHER PUBLICATIONS

Matrx Genera Back, Installation/User Manual, Motion Concepts (6 pages), Apr. 4, 2011.
Matrx Genera Back Highlights, Motion Concepts (1 page), Jul. 15, 2010.
Jay Cushions and Backs Parts Manual, Sunrise Medical (148 pages), May 2010.
Matrx Genera Back, Motion Concepts (1 page), Apr. 21, 2008.
Matrx Mounting Hardware, Motion Concepts (1 page), Aug. 2010.

* cited by examiner

*Primary Examiner* — Kevin Hurley
(74) *Attorney, Agent, or Firm* — Calfee, Halter & Griswold LLP

(57) ABSTRACT

A wheelchair mount includes a body, a band secured to the body, and a stabilizing component secured to the body. The band is sized to secure an associated wheelchair bar between the band and the stabilizing component. The stabilizing component resists rotational movement of the body relative to the wheelchair bar.

19 Claims, 5 Drawing Sheets

WHEELCHAIR MOUNT AND METHOD FOR STABILIZING A WHEELCHAIR COMPONENT

BACKGROUND

The present invention relates to a wheelchair. It finds particular application in conjunction with a clamp for attaching a wheelchair component to a wheelchair frame and will be described with particular reference thereto. It will be appreciated, however, that the invention is also amenable to other applications.

Wheelchair components (e.g., seatbacks) are typically mounted to H-shaped back frames. Tubular clamps are commonly used for securing sides of a seatback to respective vertical bars of the H-shaped frame. Center mounted seatbacks using only a single tubular clamp to a horizontal bar of the H-shaped frame of the wheelchair may offer a relatively simpler and more attractive appearance. However, providing only a single mount for securing the seatback to the wheel chair frame may result in rotational movement of the seatback that does not offer the desired stability to a user of the wheelchair.

The present invention provides a new and improved apparatus and method for mounting a wheelchair component to a wheelchair frame.

SUMMARY

In one aspect of the present invention, it is contemplated that a wheelchair mount includes a body, a band secured to the body, and a stabilizing component secured to the body. The band is sized to secure an associated wheelchair bar between the band and the stabilizing component. The stabilizing component resists rotational movement of the body relative to the wheelchair bar.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to exemplify the embodiments of this invention.

DETAILED DESCRIPTION OF ILLUSTRATED EMBODIMENT

Figure 1:
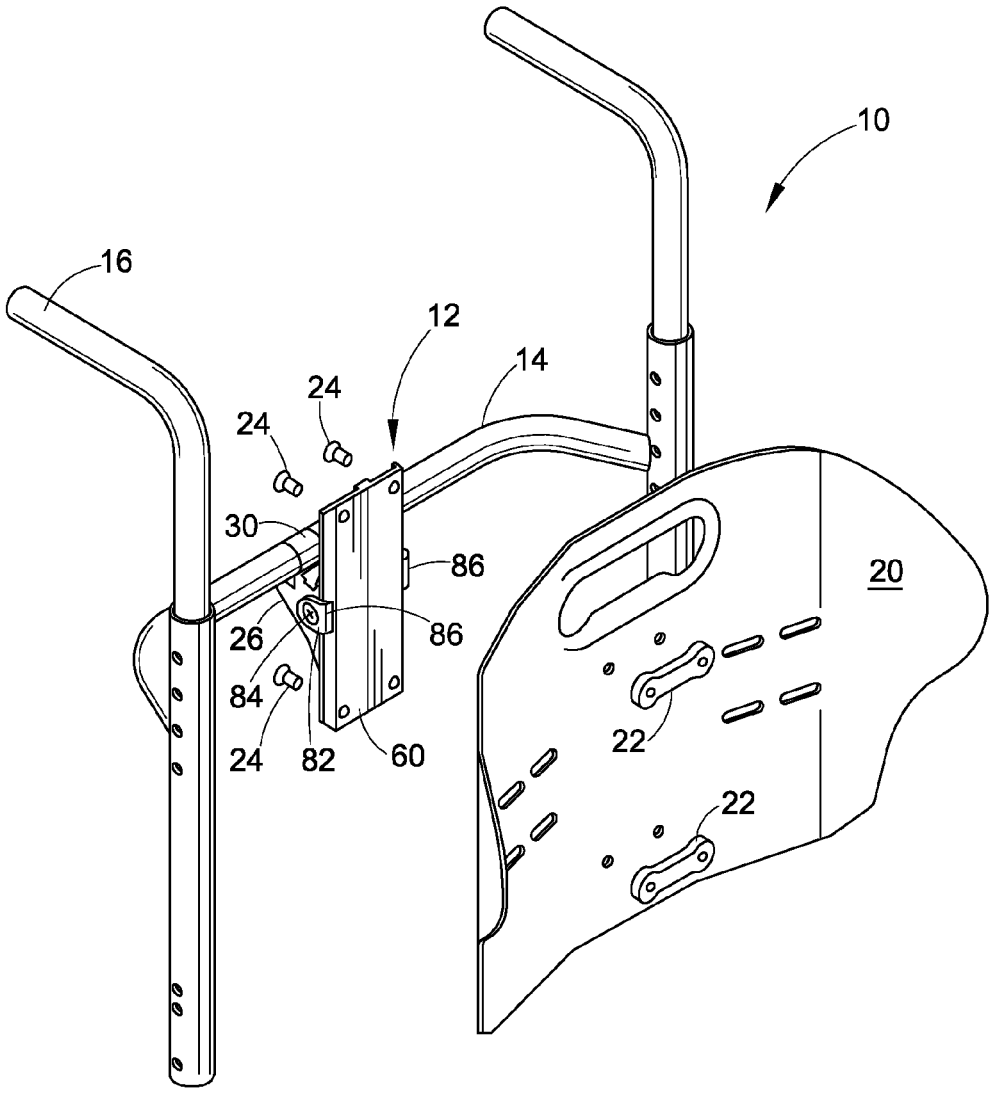
FIG. 1 illustrates a representation of a seatback mount on a wheelchair in accordance with one embodiment of an apparatus illustrating principles of the present invention.

FIG. 1 illustrates a simplified component diagram of a partial view of a wheelchair 10 including an exemplary mount 12 (e.g., a wheelchair seatback mount) in accordance with one embodiment of the present invention. In the illustrated embodiment, the mount 12 is secured to a bar (e.g., a horizontal bat) 14 of a wheelchair frame 16. It is contemplated that the bar 14 is a generally tubular shaped. Although a component (e.g., a seatback) 20 is illustrated as disconnected from the mount 12, it is to be understood the seatback 20 may be secured to the mount 12 via backing plates 22 and fasteners 24.

Figure 2:
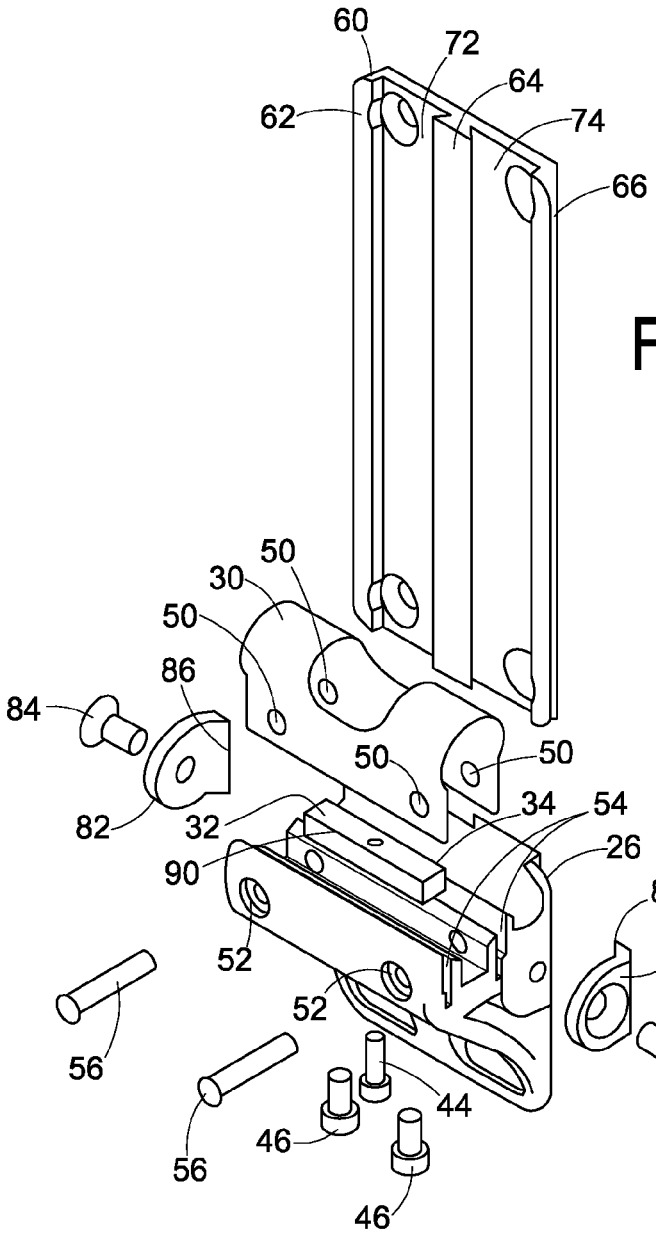
FIG. 2 illustrates an exploded representation of the seatback mount of FIG. 1 in accordance with one embodiment of an apparatus illustrating principles of the present invention.
Figure 3:
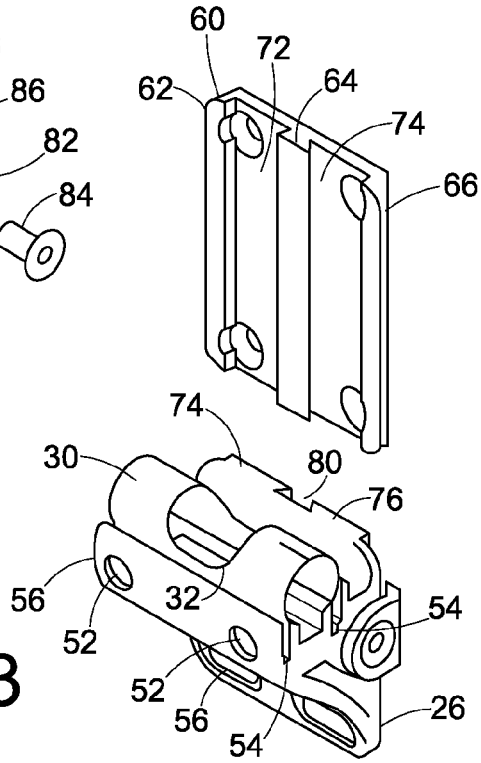
FIG. 3 illustrates a partially assembled representation of the seatback mount of FIGS. 1 and 2 in accordance with one embodiment of an apparatus illustrating principles of the present invention.

FIG. 2 illustrates an exploded view of the mount 12 shown in FIG. 1. FIG. 3 illustrates a partially assembled view of the mount 12 shown in FIGS. 1 and 2. With reference to FIGS. 2 and 3, the mount 12 includes a body 26, a hand clamp 30, and a stabilizing component 32. In one embodiment, the stabilizing component 32 is steel.

Figure 6:
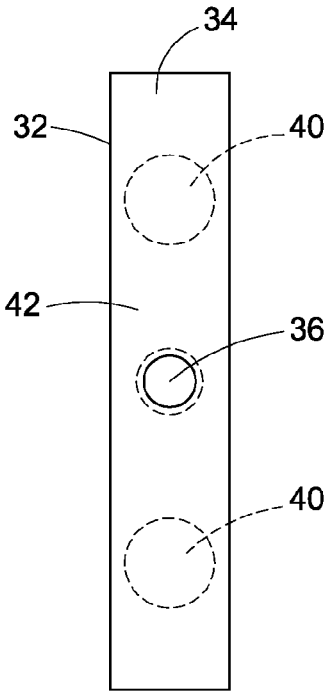
FIG. 6 illustrates a top view of the stabilizing component of the seatback mount in accordance with one embodiment of an apparatus illustrating principles of the present invention.
Figure 5:
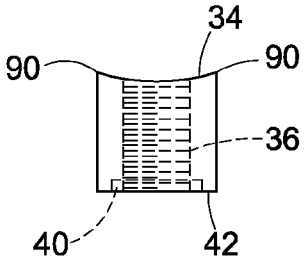
FIG. 5 illustrates a side view of the stabilizing component of the seatback mount in accordance with one embodiment of an apparatus illustrating principles of the present invention.
Figure 4:
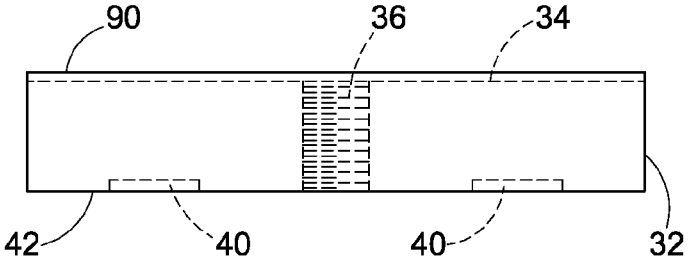
FIG. 4 illustrates a front view of a stabilizing component of the seatback mount in accordance with one embodiment of an apparatus illustrating principles of the present invention.

FIGS. 4-6 illustrate various views of the stabilizing component 32 in accordance with one embodiment of the present invention. FIG. 4 illustrates a front view of the stabilizing component 32, FIG. 5 illustrates a side view of the stabilizing component 32, and FIG. 6 illustrates a top view of the stabilizing component 32. With reference to the embodiment illustrated in FIGS. 4-6, the stabilizing component 32 is a generally rectangular bar-shaped component. A top longitudinal surface 34 includes a concave contour that is shaped to generally match a convex contour on an exterior surface of a tubular shaped bar. For example, the concave contour of the top surface 34 of the stabilizing component 32 has a radius of curvature of about 0.438" and is shaped to generally match a convex contour of the bar 14 (see FIG. 1). It is contemplated that a single radius of curvature (e.g., about 0.438") for the top surface 34 of the stabilizing component 32 is sufficiently compatible with tubular bars 14 (see FIG. 1) having diameters ranging from about ¾" to about 1¼".

The stabilizing component 32 also includes a bore 36 and two (2) recesses 40 along a bottom surface 42. With reference to FIGS. 2, 3, and 6, a retaining bolt 44 passes through the body 26 and into the bore 36 for securing the stabilizing component 32 to the body 26. In one embodiment, the retaining bolt 44 is threaded and secured within the bore 36 via complementary threads. Compression screws 46 also pass through the body 26 and into the recesses 40 of the stabilizing component 32 for positioning the stabilizing component 32 relative to the body 26. More specifically, the retaining bolt 44 is used to retain the stabilizing component 32 toward the body 26, while the compression screws 46 are used to push the stabilizing component 32 toward the body 26. The opposing forces on the stabilizing component 32 from the retaining bolt 44 and the compression screws 46 determine a position of the stabilizing component 32 relative to the body 26.

With reference again to FIGS. 2 and 3, the band clamp 30 is flexible and includes a plurality of bores 50, which align with corresponding bores 52 in the body 26 when edges of the band clamp 30 are inserted into respective channels 54 of the body 26. Once the bores 50 of the band clamp 30 are aligned with the bores 52 of the body 26, pins 56 (e.g., rivets) are passed through the bores 50, 52 to retain the band clamp 30 in place and secure the band clamp 30 to the body 26.

in one embodiment, a mounting plate 60 includes three (3) rails 62, 64, 66 and two (2) recesses 70, 72, which are defined by the rails 62, 64, 66. The body 26 includes complementary rails 74, 76 and a complementary groove 80, which is defined by the complementary rails 74, 76. The mounting plate 60 rails 62, 64, 66 and recesses 70, 72 interact with the body 26 complementary rails 74, 76 and groove 80 to define a tongue-and-groove design. The tongue-and-move design permits the mounting plate 60 to slidingly engage the body 26.

Locking wedge washers 82 are secured to the body 26 using fasteners 84. The wedge washers 82 include dovetail edges 86 that wrap around an edge of the body 26. When the mounting plate 60 slidingly engages the body 26, the wedge washers 82 also wrap around the mounting plate rails 62, 66. The fasteners 84 are tightened to frictionally engage the mounting plate rails 62, 66 against the body 26. The tongue-and-groove design of the mounting plate 60 and the body 26, the locking wedge washers 82, and the fasteners 84 allow a position (e.g., height) of the mounting plate 60 relative to the body 26 to be adjustably set along an axis of the body 26. For example, the mounting plate 60 is set to a desired position while the fasteners 84 are loosened (so the wedge washers 82 do not frictionally engage the mounting plate rails 62, 66 against the body 26). Once the desired position is obtained, the fasteners 84 and wedge washers 82 are tightened (so the wedge washers 82 frictionally engage the mounting plate rails 62, 66 against the body 26). If it is later desired to adjust the position (e.g., height) of the mounting plate 60 relative to the body 26, the fasteners 84 are loosened so the position of the mounting plate 60 may be adjusted before the fasteners 84 are tightened again.

The seatback 20 is secured to the mount 12 (e.g., the body 26) via the backing plates 22 and fasteners 24.

Figure 7:
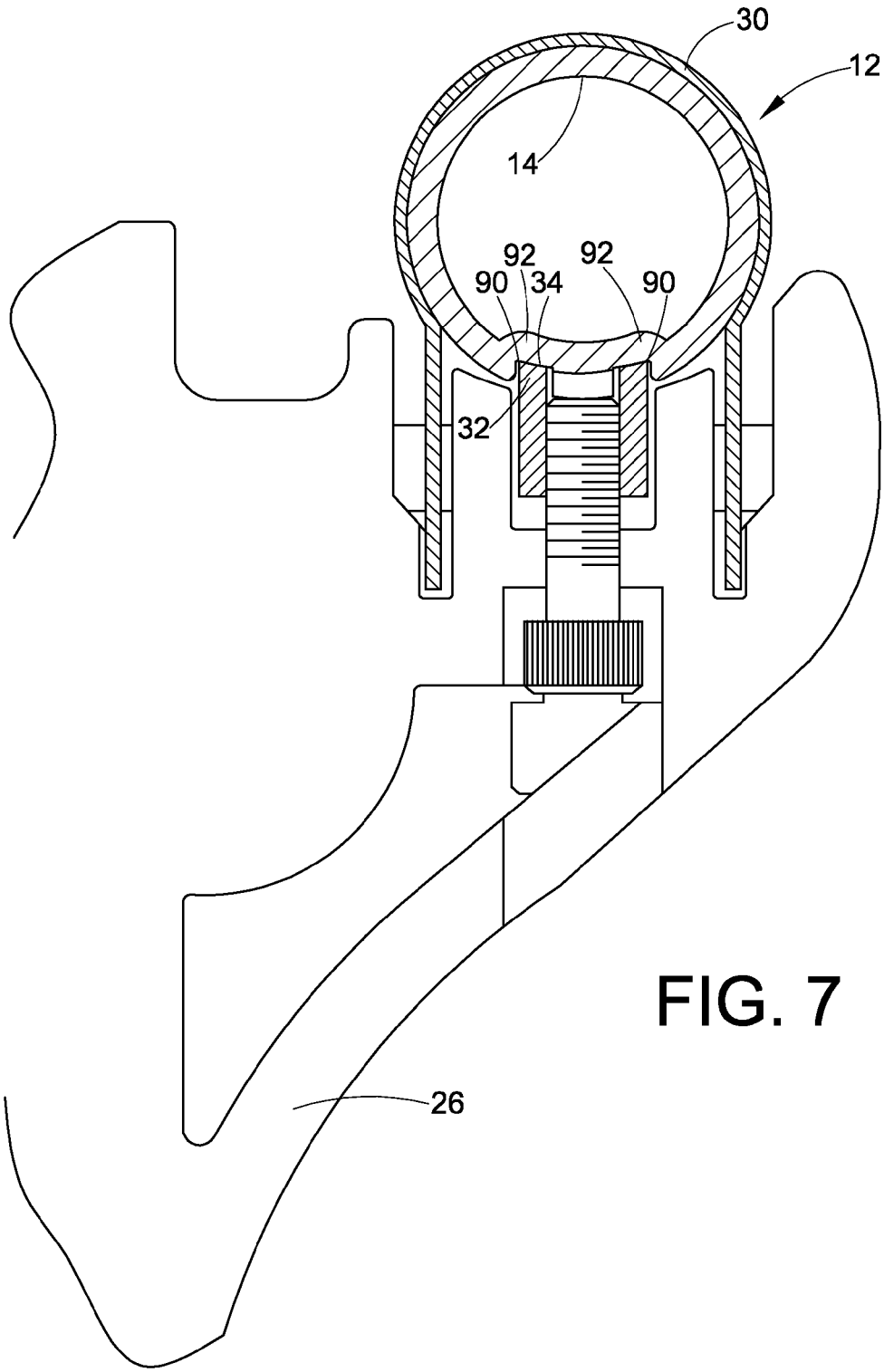
FIG. 7 illustrates a deformation of bar of a wheelchair frame in accordance with one embodiment of an apparatus illustrating principles of the present invention.

With reference to FIG. 7, the band clamp 30 is sized to secure the bar 14 (a horizontal bar of the wheelchair frame 16) between the band clamp 30 and the stabilizing component 32. The bar 14 contacts the band clamp 30 and the top surface 34 (which includes the concave contour) of the stabilizing component 32. The stabilizing component 32 is driven (e.g., compressed) against the bar 14 as the band clamp 30 is more tightly secured around the bar 14, which causes the band clamp 30 to drive (e.g., compress) the bar 14 and stabilizing component 32 together. As discussed in more detail below, the mechanical interaction between the bar 14 and the concave top surface 34 of the stabilizing component 32 acts to stabilize the mount 12 (e.g., the body 26, band clamp 30, and the stabilizing component 32) relative to the bar 14. More specifically, the stabilizing component 32 acts to resist rotational movement of the mount 12 (e.g., the body 26, band clamp 30, and the stabilizing component 32) relative to the bar 14.

The flexibility of the band clamp 30 facilitates the band clamp 30 contouring to the bar 14 as the band clamp 30 is more tightly secured around the bar 14 and to the body 26. In addition, the band includes a clamping range that allows the band to be secured to different bars that are respectively sized according to imperial and metric measurements. For example, the band 30 is sized to provide a clamping range of about 2 mm. Different sized bands 30 (e.g., ¾", ⅞", and 1/1;4") are contemplated to accommodate different sized frame bars 14.

Edges 90 of the contoured top surface 34 of the stabilizing component 32 are compressed against the bar 14 as the band clamp 30 is more tightly secured around the bar 14. In this manner, frictional engagement is created between the stabilizing component 32 and the bar 14. In one embodiment, the frictional engagement between the stabilizing component 32 and the bar 14 acts to stabilize the mount 12 (e.g., the body 26, band clamp 30, and the stabilizing component 32) relative to the bar 14. In other words, the frictional engagement between the stabilizing component 32 and the bar 14 acts to resist rotational movement of the mount 12 (e.g., the body 26, band clamp 30, and the stabilizing component 32) relative to the bar 14.

It is also contemplated that, as the band clamp 30 is more tightly secured around the bar 14, the edge 90 of the contoured top surface 34 of the stabilizing component 32 may dig-into and/or deform the bar 14. The deformation of the bar 14 may increase if, for example, the seatback 20 and, consequently, the body 26 are rotated around the bar 14. The deformation in the bar 14 forms a wall (e.g., a stop) 92 that engages the respective edge 90 of the contoured top surface 34 of the stabilizing component 32 to resist further rotational movement of the seatback 20 (and the body 26) around the bar 14. It is contemplated that the bar 14 is a relatively softer material than the stabilizing component 32. For example, if the stabilizing component 32 is steel, the bar 14 may be an aluminum material (e.g., anodized aluminum) or titanium.

In another embodiment, it is also contemplated that the bar 14 includes a coating. The coating contacts the stabilizing component as the stabilizing component 32 is compressed against the bar 14. As discussed above, it is contemplated that the coating frictionally engages the stabilizing component 32 if the seatback 20 and, consequently, the body 26 are rotated around the bar 14. In addition, in this embodiment, the edge 90 of the contoured top surface 34 of the stabilizing component 32 may dig into and deform the coating and/or the bar 14 if the seatback 20 and, consequently, the body 26 are rotated around the bar 14. The deformation in the coating and/or the bar 14 may form the wall 92 (e.g., the stop) that engages the respective edge 90 of the contoured top surface 34 of the stabilizing component 32 to resist further rotational movement of the seatback 20 (and the body 26) around the bar 14.

Because the wheelchair seatback mount 12 discussed above resists rotational movement around the bar 14, it is contemplated that a single mount 12 may be used for securing the seatback 20 to the frame 16. A single mount for securing the seatback 20 to the frame 16 offers a relatively simpler and more attractive appearance, while maintaining desired stability of the seatback 20 for a user entering, exiting, and/or simply riding in the wheelchair.

Figure 8:
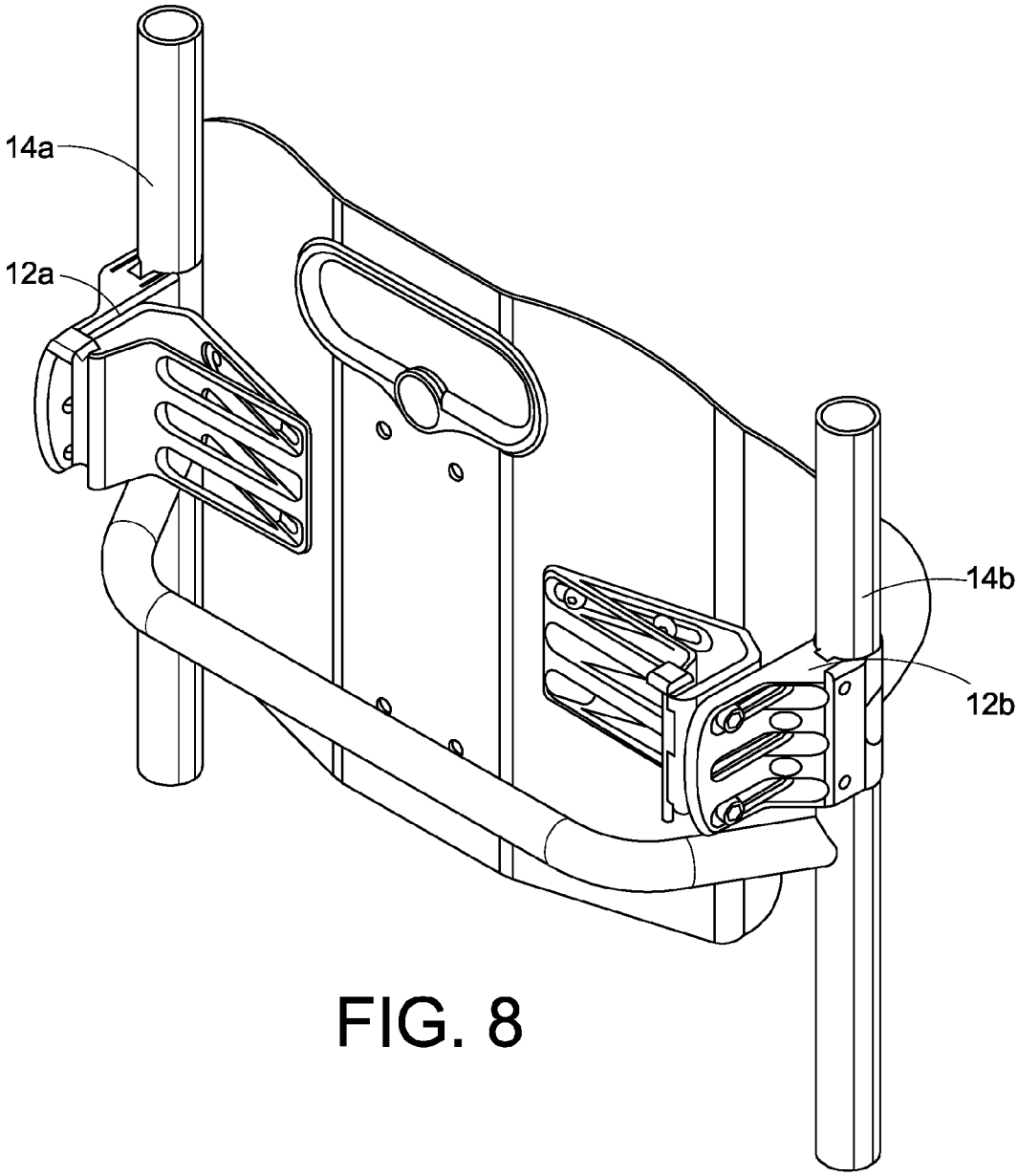
FIG. 8 illustrates a representation of two seatback mounts on respective vertical bars of a wheelchair frame in accordance with one embodiment of an apparatus illustrating principles of the present invention.

FIG. 8 illustrates a simplified component diagram of a partial view of a wheelchair 10 including exemplary mounts 12*a*, 12*b* (e.g., wheelchair seatback mounts) oriented approximately 90° from the seatback mount 12 (see FIG. 1). As illustrated in FIG. 8, the seatback mounts 12*a*, 12*b* are secured to bars (e.g., tubular shaped vertical bars) 14*a*, 14*b*, respectively, of the wheelchair frame 16. It is contemplated that the bars 14*a*, 14*b*, like the bar 14, are generally tubular shaped. It is to be understood that the wheelchair seatback mounts 12*a*, 12*b* simply represent the wheelchair seatback mount 12 in a different orientation. The orientation of the seatback mounts 12*a*, 12*b* function to reduce rotation around the bars (e.g., vertical bars) 14*a*, 14*b*, respectively, in the same manner the seatback mount 12 (see FIG. 1) functions to reduce rotation around the (e.g., horizontal bar) bar 14 (see FIG. 1).

Although the mounts 12, 12*a*, 12*b* have been described as mounting wheelchair seatbacks, it is to be understood that the mounts 12, 12*a*, 12*b* are also contemplated to be used for mounting joysticks, accessory interfaces, etc. and/or any other application (e.g., tubular mounting application) where rotation resistant clamping to a tubular structure is desired.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

I claim:

1. A wheelchair mount, comprising:

a body;

a band secured to the body;

a stabilizing component secured to the body, the band being sized to secure an associated wheelchair bar between the band and the stabilizing component, the stabilizing component resisting rotational movement of the body relative to the wheelchair bar; and a compression device, separate from both the body and the band, passing through the body and engaging the stabilizing component to position the stabilizing component relative to the body and the band, and the stabilizing component being driven against the wheelchair bar as the band is more tightly secured around the wheelchair bar and to the body.

2. The wheelchair mount as set forth in claim 1, wherein:

an edge of the stabilizing component engages the wheelchair bar as the band is more tightly secured around the wheelchair bar and to the body; and the engagement of the edge of the stabilizing component with the wheelchair bar resists the rotational movement of the body relative to the wheelchair bar.

3. The wheelchair mount as set forth in claim 1, wherein:

the compression device is a screw.

4. The wheelchair mount as set forth in claim 1, wherein:

frictional engagement between the stabilizing component and the wheelchair bar is created as the stabilizing component is driven against the wheelchair bar; and the frictional engagement between the stabilizing component and the wheelchair bar resists the rotational movement of the body relative to the wheelchair bar.

5. The wheelchair mount as set forth in claim 1, wherein:

the stabilizing component is contoured to substantially match a shape of the wheelchair bar.

6. The wheelchair mount as set forth in claim 5, wherein:

the stabilizing component is contoured to substantially match a tubular shaped wheelchair bar.

7. The wheelchair mount as set forth in claim 1, wherein:

the band is flexible to facilitate the band contouring to the wheelchair bar as the band is more tightly secured around the wheelchair bar and to the body.

8. The wheelchair mount as set forth in claim 1, wherein:

the band is sized to provide a clamping range of about 2 mm.

9. A wheelchair mount, comprising:

a body;

a band secured to the body; and a stabilizing component secured to the body, the band being sized to secure an associated wheelchair bar between the band and the stabilizing component, the stabilizing component resisting rotational movement of the body relative to the wheelchair bar, the stabilizing component being driven against the wheelchair bar as the band is more tightly secured around the wheelchair bar and to the body;

a mounting plate adjustably secured to the body at any position along an axis of the body;

wherein the mounting plate is capable of being mounted to an associated wheelchair seatback; and wherein a height of the associated wheelchair seatback is based on the position of the mounting plate along the axis of the body.

10. The wheelchair mount as set forth in claim 9, wherein:

an edge of the stabilizing component engages the wheelchair bar as the band is more tightly secured around the wheelchair bar and to the body; and the engagement of the edge of the stabilizing component with the wheelchair bar resists the rotational movement of the body relative to the wheelchair bar.

11. The wheelchair mount as set forth in claim 9, wherein:

frictional engagement between the stabilizing component and the wheelchair bar is created as the stabilizing component is driven against the wheelchair bar; and the frictional engagement between the stabilizing component and the wheelchair bar resists the rotational movement of the body relative to the wheelchair bar.

12. The wheelchair mount as set forth in claim 9, wherein:

the stabilizing component is contoured to substantially match a shape of the wheelchair bar.

13. The wheelchair mount as set forth in claim 9, wherein:

the band is flexible to facilitate the band contouring to the wheelchair bar as the band is more tightly secured around the wheelchair bar and to the body.

14. A wheelchair mount, comprising:

a body;

a band secured to the body, a position of the body being fixed relative to the band;

a stabilizing component secured to the body, the band being sized to secure an associated wheelchair bar between the band and the stabilizing component, the stabilizing component resisting rotational movement of the body relative to the wheelchair bar; and a compression device passing through the body and engaging the stabilizing component to position the stabilizing component relative to the body and the band, the stabilizing component being compressed against the wheelchair bar based on the position of the stabilizing component set by the compression device.

15. The wheelchair mount as set forth in claim 14, wherein:

an engagement of an edge of the stabilizing component with the wheelchair bar resists the rotational movement of the wheelchair bar relative to the body relative.

16. The wheelchair mount as set forth in claim 14, wherein:

the edge of the stabilizing component digs-into the wheelchair bar to resist the rotational movement of the wheelchair bar relative to the body.

17. The wheelchair mount as set forth in claim 16, wherein:

the wheelchair bar is deformed to create a stop when the edge of the stabilizing component digs-into the wheelchair bar.

18. The wheelchair mount as set forth in claim 17, wherein:

the stop engages with the edge of the stabilizing component to resist the rotational movement of the wheelchair bar relative to the body.

19. The wheelchair mount as set forth in claim 14, wherein:

the compression device is a screw.

* * * * *